US008782911B1

(12) United States Patent
Greene

(10) Patent No.: US 8,782,911 B1
(45) Date of Patent: Jul. 22, 2014

(54) VERSATILE SHAVER

(75) Inventor: Todd M. Greene, Culver City, CA (US)

(73) Assignee: Headblade, Inc., Culver City, CA (US)

( * ) Notice: Subject to any disclaimer, the term of this patent is extended or adjusted under 35 U.S.C. 154(b) by 120 days.

(21) Appl. No.: 13/427,804

(22) Filed: Mar. 22, 2012

(51) Int. Cl.
*B26B 21/52* (2006.01)

(52) U.S. Cl.
USPC ..... 30/526; 30/298; 30/537

(58) Field of Classification Search
CPC ..... B26B 21/522; B26B 21/527
USPC ..... 30/298, 526, 527, 291, 537; D28/48
See application file for complete search history.

(56) References Cited

U.S. PATENT DOCUMENTS

| | | | | | |
|---|---|---|---|---|---|
| 773,782 | A | * | 11/1904 | Brown, Jr. | 30/298 |
| 861,422 | A | * | 7/1907 | Astorgis | 30/69 |
| 1,946,731 | A | * | 2/1934 | Castain | 30/294 |
| D146,759 | S | * | 5/1947 | Brown | D28/46 |
| 3,014,506 | A | * | 12/1961 | Crimmins et al. | 140/93.2 |
| 4,283,854 | A | * | 8/1981 | Austin | 30/314 |
| 5,038,479 | A | * | 8/1991 | Davis | 30/298 |
| 5,659,962 | A | * | 8/1997 | Tagou | 30/279.6 |
| 6,029,356 | A | * | 2/2000 | Sprinkle | 30/298 |
| 6,112,421 | A | * | 9/2000 | Greene | 30/526 |
| 6,550,148 | B2 | * | 4/2003 | Cecil | 30/526 |
| 7,140,115 | B2 | * | 11/2006 | Greene | 30/526 |
| 7,874,076 | B2 | * | 1/2011 | Gratsias et al. | 30/526 |
| D667,168 | S | * | 9/2012 | Greene | D28/48 |
| 2011/0088269 | A1 | * | 4/2011 | Walker et al. | 30/527 |

FOREIGN PATENT DOCUMENTS

| | | | | |
|---|---|---|---|---|
| GB | 2 265 105 | A | * | 9/1993 |

* cited by examiner

*Primary Examiner* — Hwei C Payer
(74) *Attorney, Agent, or Firm* — Stefan J. Kirchanski; Venable LLP

(57) ABSTRACT

A versatile shaver has a shaver body with a blade cartridge mounted at one end of the underside and a rotating wheel at the other end. A resilient finger hook and associated pads are located on an upper surface. A user can insert an index finger through the hook and use the shaver in a palm grip to shave the scalp. The shaver body narrows between the blade end and the wheel end thus facilitating a grip between the fingers and thumb for ready shaving of the face.

16 Claims, 5 Drawing Sheets

VERSATILE SHAVER

CROSS-REFERENCE TO PRIOR APPLICATIONS

Not Applicable

U.S. GOVERNMENT SUPPORT

Not Applicable

BACKGROUND OF THE INVENTION

Area of the Art

DESCRIPTION OF THE BACKGROUND

A number of different shaving devices are available. The vast majority of such shaving devices primarily are designed for shaving a man's face or for shaving a woman's legs or other portions of the human torso. In fact, a single design often has been used for shaving many different body areas. By far, the most common of such multi-purpose designs utilizes a substantially straight handle shaped to be grasped by one hand, which handle curves or otherwise transitions into a head portion, wherein the razor blade is mounted. The long axis of the razor blade is oriented approximately at right angles to the long axis of the handle. Such an orientation generally facilitates a straight shaving stroke.

It will be appreciated that the angle the cutting edge of the blade (or blades in multiple blade systems) makes with the surface to be shaved is critical. This "cutting angle" is angle formed between the surface and the plane of the blade with the actual cutting edge in contact with the surface forming the apex of the angle. For effective shaving, the cutting angle should be a relatively small acute angle. If the relationship between the blade and handle (in a traditional razor system) is fixed, the plane of the blade approaches being parallel to the long axis of the handle. In this way when the razor is stroked along a surface to be shaved (e.g. a cheek), the cutting angle is "automatically" an effective acute angle. However, in most modern razor systems, the blade (or blades) is held at a predetermined angle in a replaceable cartridge that frames the blade (or blades). The cartridge, in turn, is mounted on some type of mechanical swivel so the when the cartridge is brought into contact with the surface to be shave, the entire assembly pivots to ensure an optimal cutting angle.

Shaver designs other than the simple "straight handle shaver" are available. For example, U.S. Pat. No. D426,918 ("Razor Having Finger Retainer), U.S. Pat. No. 6,112,421 ("Multi-Use Razor,"), U.S. Pat. No. 6,018,877 ("Versatile Finger Retained Razor,") and U.S. Pat. No. 7,140,115 ("Shaving Apparatus with Wheel") issued to the present inventor, describe and illustrate different designs that utilizes a short body (as opposed to a straight handle) and a hook, either open or closed (e.g. a ring) along the top surface of the shaver, for engaging a user's finger to assist in manipulating the shaver. The foregoing patents are incorporated herein by reference as though set forth herein in full.

The shaver designs disclosed in the foregoing patents have particular applicability to, and are particularly well-suited to, shaving one's head. However, the present inventor has discovered that additional improvements can be made to provide better results and to enhance the versatility of such shavers.

SUMMARY OF THE INVENTION

The present invention therefore addresses the need for versatile shavers by providing a shaver that has one or more of the following elements: a wheel or other rolling device on the same side as the razor blade, an adjustable finger hook for accommodating fingers of different sizes and a narrowing or "waist" in the shaver body to facilitate grasping the device when shaving the user's face. The waist allows the shaver to be grasped for shaving the face, and when compared to straight handle razors, grasping this shaver at the waist with the index finger accommodated by the protuberance results in improved stability and control of the razor.

A blade clip and the attached blade are disposed at the rear end of the shaver body. Wheels are mounted at the end of the shaver opposite the blade. The cutting edge of the blade is disposed so that the shaving stroke moves towards the wheels.

The clip results in a two point contact when the shaver is placed on a planar surface. That is, only the wheels and the rearmost edge of the cartridge touch the surface. A resilient plastic spring arm allows the cartridge to flex at its attachment point so that downward pressure on the shaver will cause the entire cartridge to flex so that it is parallel to the planar surface on which it rests.

A finger hook and pads are provided for gripping the shaver to shave the user's scalp. In a preferred embodiment the pad nearest the blade is associated with an overarching protuberance extending from the hook. The user's index or middle finger can be inserted through the hook in a "palm grip" which allows ready shaving of the scalp.

The indentation or "waist" allows a user to grasp the shaver between the fingers and the thumb much like a traditional straight handle razor with the user's index finger advantageously accommodated by the protuberance. For some parts of the body, this "waist grip is preferred. For other areas of the body, the "palm grip" is more effective. This single versatile configuration can be used to shave virtually all regions of the body.

By virtue of the foregoing arrangements, a shaver can be provided that often has improved comfort and friction reduction, as well as providing the user with better control in certain circumstances. The present invention is well-suited to shavers having a finger hook (e.g., for holding and controlling the shaver using the middle three fingers) or other means for grasping the shaver along the top of the main body to shave, for example, the user's scalp.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a versatile shaver for shaving the scalp as well as other areas of the human body.

Figure 1:
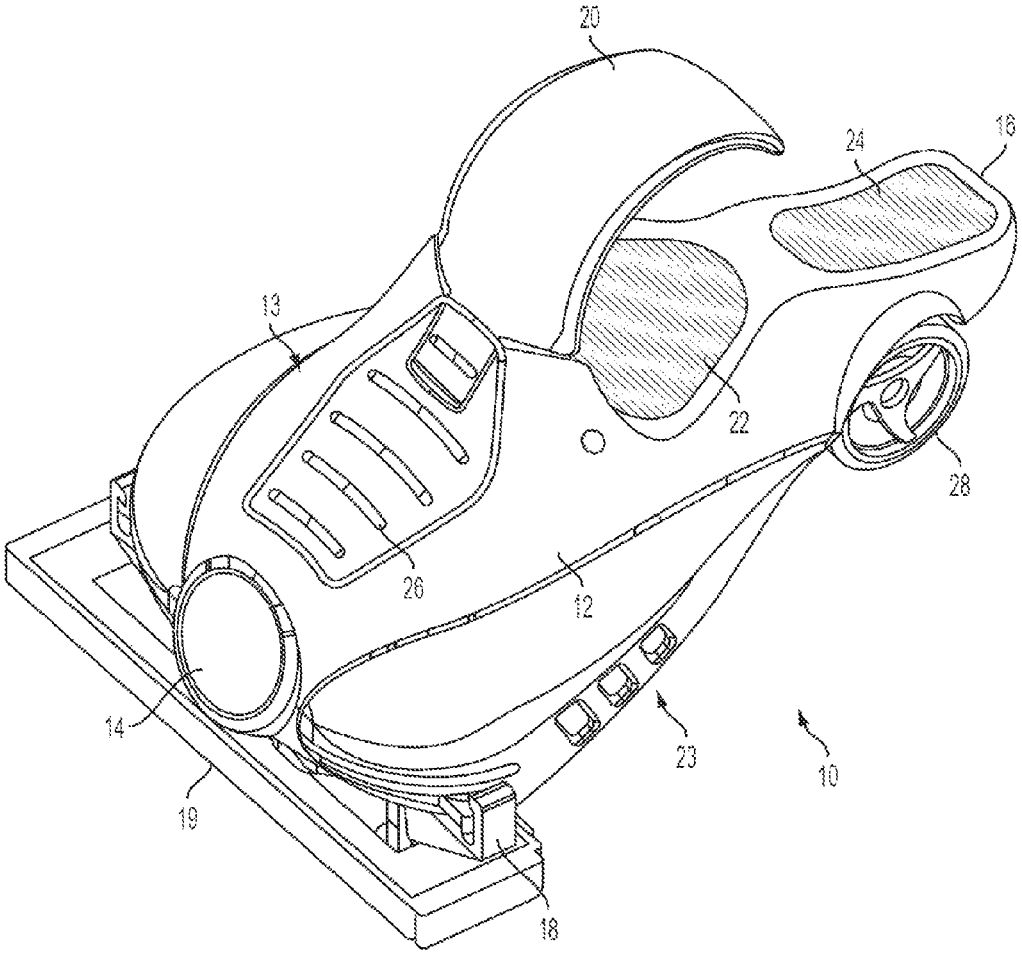
FIG. 1 PRIOR ART
FIG. 1 is shows a perspective view of a PRIOR ART shaver that is optimized for shaving a user's scalp.

FIG. 1 shows the prior art shaver disclosed in U.S. Pat. No. 7,140,115 to make it easier to appreciate the changes between that device and new device. The figure illustrates a shaver 10 that utilizes a relatively short body 12 (e.g. approximately 65-70 mm in length) that is also taller than most conventional shavers (e.g. approximately 40 mm in height, including finger hook 20). The, main body 12 is approximately triangular in shape, being wider at the blade end 14 (e.g., approximately 40 mm wide) where the razor blade attachment clip 18 is mounted than at the wheel end 16 (e.g., approximately 13 mm wide).

A razor blade attachment clip 18 for permitting a razor blade 19 to be attached to shaver 10 is preferably detachable and re-attachable to the body 12 of shaver 10. The attachment clip 18 provides a mechanical interface for the removable attachment of a razor blade 19. The razor blade 19 preferably is a conventional disposable razor blade cartridge that includes the blade (or blades) in a supporting cartridge. It will be apparent that the mechanical interface can be integral to the shaver 10 so that the razor blade 19 attaches directly to the body without an intervening removable clip 18. In the preferred embodiment, the shaver 10 is configured such that when it is resting on a planar surface only the wheel 28 and the razor blade/cartridge 19 will make contact with the surface (with the plane of the blade essentially parallel to the surface). The clip 18 (or the integral attachment interface) provides a resilient spring-action so that the cartridge adjusts in response to changes in the surface to be shaved. Ordinarily, a razor blade 19 is installed so that its cutting edge 11 faces toward the blade end 14 of shaver 10, meaning that shaving will occur when the shaver 10 is moved along the skin in a cutting direction such that the blade end 14 is the leading end. That is, with the device of FIG. 1, the blade shaves a surface when the shaver 10 moves away from the wheel end 16.

Similar to the shavers disclosed in the other prior art patents, shaver 10 includes a finger hook 20 (which, as illustrated, is open in the preferred embodiment) and pads 22, 24 and 26 on its upper surface 13 for allowing manipulation of shaver 10 using the middle three fingers on the user's hand. More specifically, the user typically would place his or her index finger on pad 26, middle finger on pad 22 (underneath finger hook 20) and ring finger on pad 24. Alternatively, shaver 10 may be reversed so that the index finger rests on pad 24 and the ring finger rests on pad 26. In either event, shaver 10 is held and manipulated on the palm side of the user's hand. The use of finger hook 20 and pads 22, 24 and 26 in this manner permits manipulation of a shaver 10 in a way that is more natural and particularly well-suited for shaving the user's head. With the use of a disposable razor blade 19 detachably mounted to the lower surface 23 of shaver 10, the user can shave his or her head using the same motion that one ordinarily would be used to smooth one's hair. To ensure that the shaver moves smoothly over the surface of the user's scalp a wheel 28 is attached to the end 16 of shaver 10 opposite the blade.

Figure 2:
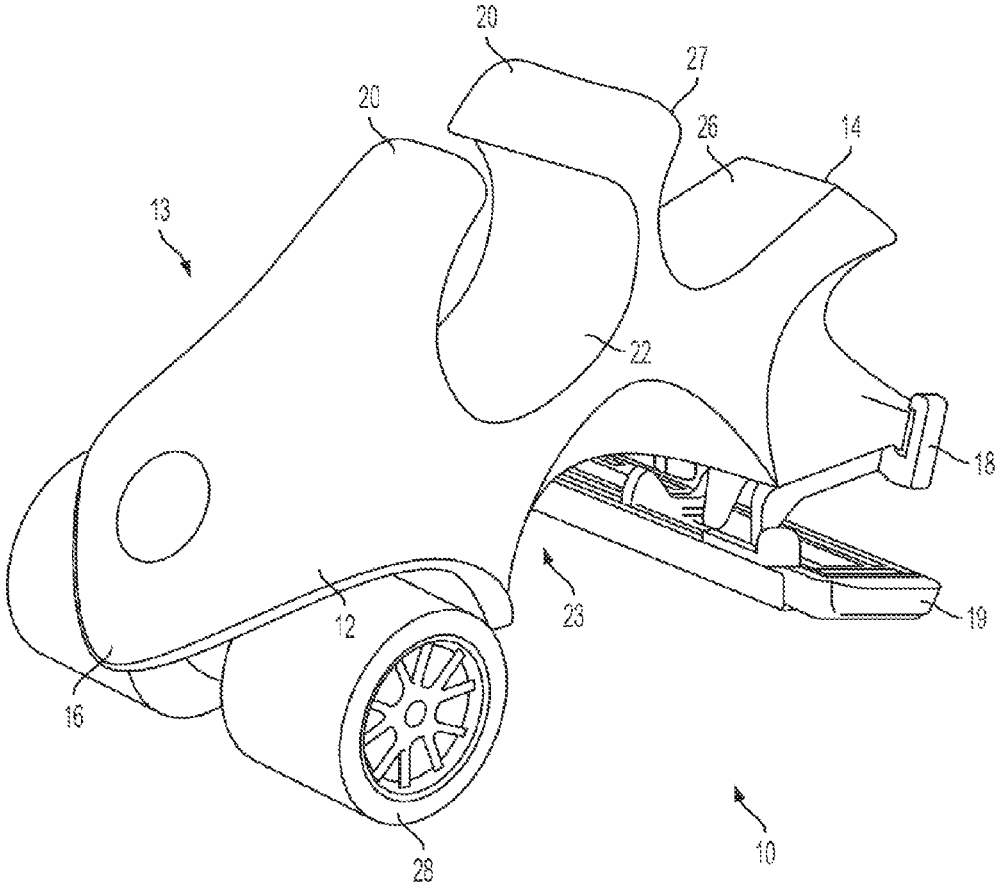
FIG. 2 shows a perspective view of the present invention for comparison with the device of FIG. 1.

FIG. 2 shows the shaver of the current invention. Although superficially similar to the shaver of FIG. 1, there are a number of significant differences. The body 12 is less of a triangular shape with the blade end 14 being only slightly wider than the wheel end 16 (approximately 50 mm versus approximately 45 mm at the widest two point in a current embodiment). In this device the blade clip 18 (or integral blade attachment interface) and the attached blade/cartridge 19 are disposed at the blade end 14 of the body 12 with the cutting edge of the blade pointing towards the wheel end 16. Therefore, the shaving stroke direction in this device is towards the wheels 28 rather than away from the wheels 28. The finger hook 20 and pads are somewhat reconfigured. The finger hook 20 is formed in two parts so as to surround both sides of an inserted finger. In a preferred embodiment the pad 26 nearest the blade end 14 is associated with a somewhat overarching protuberance 27 extending from the outer surface one half of the hook 20. Unlike the device of FIG. 1 there is no distinct pad associated with the wheel end 16 of the shaver 10. Finally, a different configuration of the blade attachment interface (e.g. the blade clip 18) results in a two point contact when the shaver 10 is placed on a planar surface. That is, only the wheels 28 and the rearmost edge of the cartridge 19 touch the surface. The cartridge 19 is preferably hingedly attached to the clip 18 at the frontmost edge of the cartridge 19 so that a resilient plastic spring arm allows the cartridge 19 to flex at the attachment point. Downward pressure on the shaver 10 will cause the entire cartridge 19 to reorient so that it is parallel to the planar surface on which it rests. In the device of FIG. 1 the entire face of the blade/cartridge 19 rests on the surface so that the shaving angle does not readily change in response to downward pressure.

Figure 3:
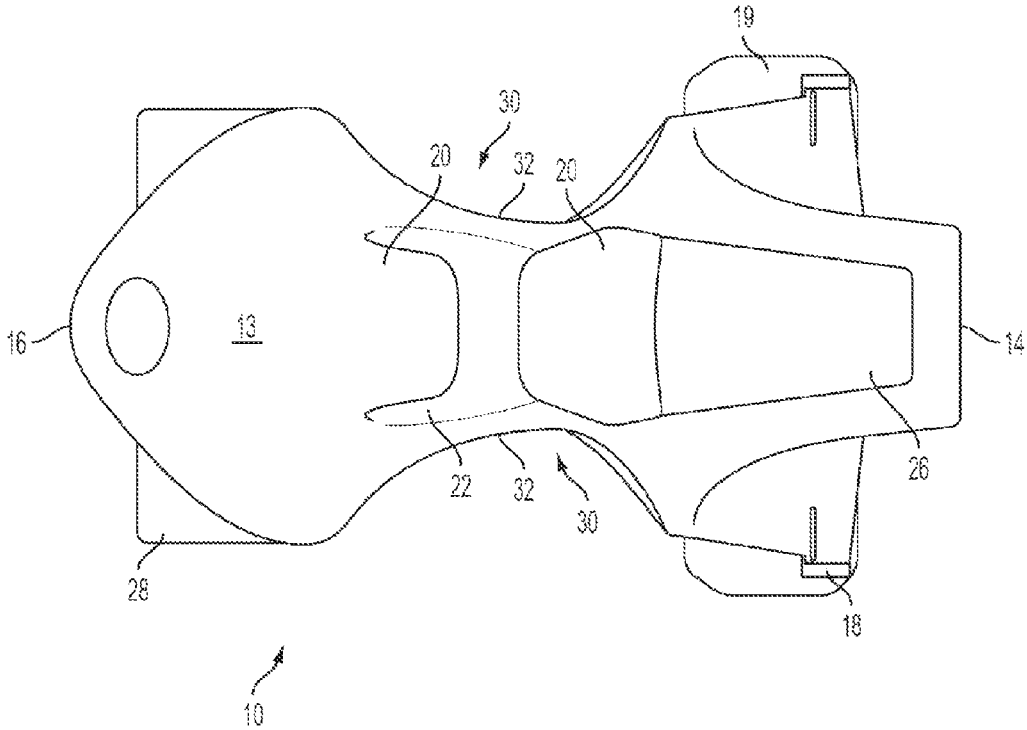
FIG. 3 shows the shaver of FIG. 2 from above.
Figure 4:
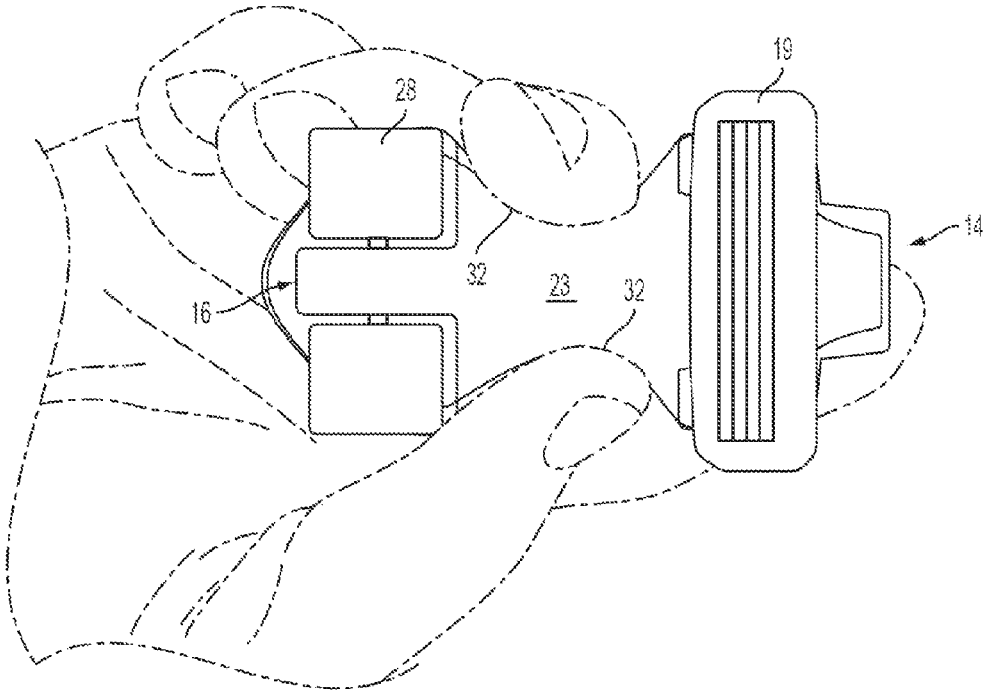
FIG. 4 illustrates one way to grasp the shaver of FIG. 2 to shave, for example, one's face.
Figure 5:
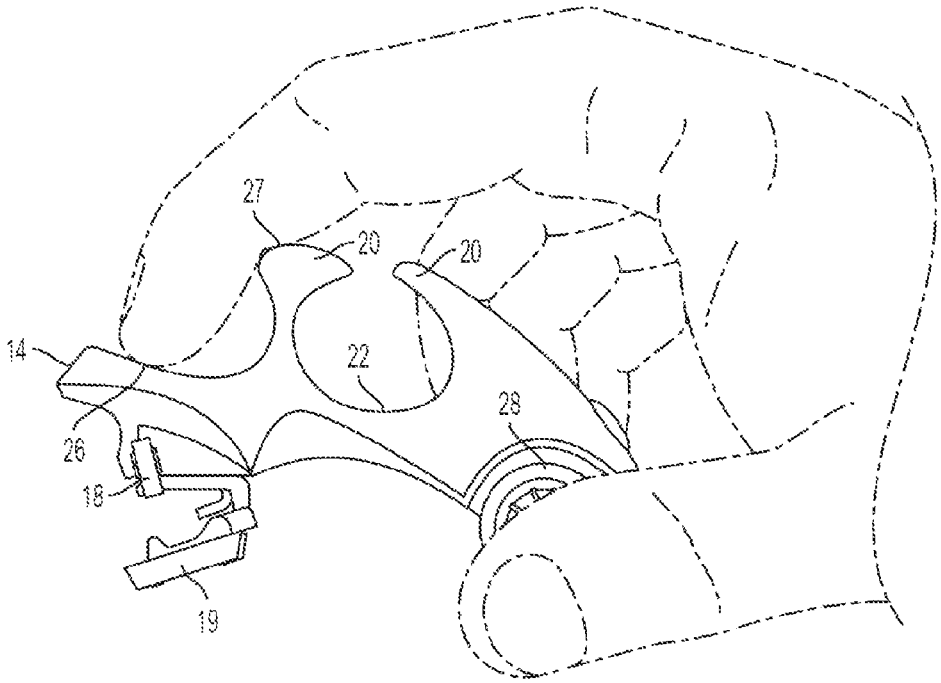
FIG. 5 illustrates a different way to grasp the shaver of FIG. 2 to shave, for example, one's face.

These differences significantly extend the range of use of the shaver. Like the prior art shaver of FIG. 1 the new shaver is ideal for shaving a user's scalp. The user's index or middle finger can be inserted into the resilient hook 20 in a "palm grip" with the fingers resting on pads 22 and 26 which allows ready shaving of the scalp. Unlike the prior art FIG. 1 device the shaving stroke moves away from the blade assembly 19 and towards the wheels 28. However, unlike the prior art design this shaver 10 can also be used to shave the torso, legs or face like a conventional straight handle razor. FIG. 3 is the shaver 10 viewed from above revealing that the body has one of more indentations 30 between the front end 14 and the rear end 16 to form a "waist" (the body 12 is approximately 22 mm wide at this point in the pictured embodiment). This allows a user to grasp the razor between the fingers and the thumb much like a traditional straight handle razor. FIG. 4 illustrates such a "waist grip" wherein the thumb and middle finger pinch the indentations 30 and the middle finger conveniently rests on the blade end 14 of the body 12. FIG. 5 shows a second configuration for a "waist grip. Here the soft resilient wheels 28 are grasped between the thumb and middle-ring fingers with part of the middle finger accommodated by the indentation 30. The index finger contacts the blade pad 26 and is stabilized by the resilient protuberance 27. It will be appreciated that other variations of the "waist grip" are also possible. When held in any of these ways the blade end 14 of the shaver is analogous to the upper blade end of a conventional razor used for face shaving. Note that when grasping the shaver, the user's index finger is advantageously accommodated by the protuberance 27 or the blade end 14 of the shave 12. A similar grip is useful for shaving a user's legs. It will be understood that the waist indentations 30, the protuberance 27 and the flat blade end 14 of the shaver 10 provide a variety of comfortable ways to securely grip the shaver 10 even when it is wet and soapy. These "waist grips" actually provide better purchase and provide improved control over a wet and slippery shaver than does gripping a conventional handled razor. For other areas on the torso either a waist grip or a palm grip is optimal depending on the exact region of the torso to be shaved.

It will be further appreciated how the "waist," the protuberance 27 and the blade end 14 significantly extend the versatility of the shaver. The full benefits of the palm grip wheel design are retained for shaving the scalp with the wheel providing stability and freedom from drag. At the same time the "waist grip" allows the shaver to be grasped for shaving the face. As compared to straight handle razors, grasping this shaver at the waist 32 or wheels 20 with the index finger accommodated by the protuberance 27 results in better stability and control of the razor for shaving the face because the body of the shaver is more nearly in line with the bones of the user's forearm allowing improved control by means of flexing the wrist joint.

The following claims are thus to be understood to include what is specifically illustrated and described above, what is conceptually equivalent, what can be obviously substituted and also what incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A shaving apparatus comprising:

a body comprising an upper surface, a lower surface, a first end and a second end;

an attachment for at least one razor blade disposed on the lower surface at the first end;

a blade cartridge containing at least one blade, the cartridge flexibly attached to the attachment with a cutting edge of the at least one blade disposed towards the second end of the body;

a finger hook disposed on the upper surface through which a user's finger can be inserted with the finger essentially parallel to the cutting edge;

a grasping region in the body between the first end and the second end so that a user can grasp the body at the grasping region; and a protuberance associated with an outer surface of the finger hook facing the first end to accommodate the user's finger when the user grasps the body, thereby stabilizing the shaving apparatus;

a wheel rotatingly attached to the lower surface of the second end, an axis of rotation of the wheel parallel to the cutting edge.

2. The shaving apparatus according to claim 1, wherein the attachment is a blade clip.

3. The shaving apparatus according to claim 2, wherein the blade clip is removably attached to the body.

4. The shaving apparatus according to claim 2, wherein the blade clip and the blade cartridge are unitary.

5. The shaving apparatus according to claim 2, wherein the blade cartridge is removably attached to the blade clip.

6. The shaving apparatus according to claim 5, wherein a hinge attaches the blade cartridge to the blade clip.

7. The shaving apparatus according to claim 1, wherein the grasping region comprises at least one indentation in the body.

8. The shaving apparatus according to claim 7 comprising two juxtaposed indentations forming a waist therebetween.

9. The shaving apparatus according to claim 1, wherein the body and the blade cartridge are configured such that when the shaving apparatus is placed on a planar surface with the lower surface facing the planar surface, only an edge of the blade cartridge farthest from the wheel and the wheel contact the planar surface.

10. A shaving apparatus comprising:

a body comprising an upper surface, a lower surface, a first end and a second end;

a blade clip disposed on the lower surface at the first end;

a blade cartridge containing at least one blade, the cartridge flexibly attached to the blade clip with a cutting edge of the at least one blade disposed towards the second end;

a finger hook disposed on the upper surface through which a user's finger can be inserted with the finger essentially parallel to the cutting edge;

an indentation in the body between the first end and the second end to facilitate a user grasp of the body;

a protuberance associated with an outer surface of the finger hook facing the first end to accommodate the user's finger when the user grasps the body, thereby stabilizing the shaving apparatus;

a wheel rotatingly attached to the lower surface near the second end, an axis of rotation of the wheel parallel to the cutting edge.

11. The shaving apparatus according to claim 10 further comprising at least two juxtaposed indentations forming a waist therebetween.

12. The shaving apparatus according to claim 10, wherein the blade clip and the blade cartridge are unitary.

13. The shaving apparatus according to claim 10, wherein the body and the clip are configured such that when the shaving apparatus is placed on a planar surface with the lower surface facing the planar surface, only an edge of the blade cartridge farthest from the wheel and the wheel contact the planar surface.

14. The shaving apparatus according to claim 10, wherein the blade clip is removably attached to the body.

15. The shaving apparatus according to claim 10, wherein the blade cartridge is removably attached to the blade clip.

16. The shaving apparatus according to claim 15, wherein a hinge attaches the blade cartridge to the blade clip.

* * * * *